United States Patent [19]

Mehnert

[11] 4,240,612

[45] Dec. 23, 1980

[54] WINCH FOR THE SLIP-FREE HAULING OF A ROPE

[75] Inventor: Walter Mehnert, Ottobrunn, Fed. Rep. of Germany

[73] Assignee: Firma Naviga-Etablissement, Vaduz, Liechtenstein

[21] Appl. No.: 26,944

[22] Filed: Apr. 4, 1979

[51] Int. Cl.[3] ..... A62B 1/08

[52] U.S. Cl. ..... 254/344; 254/365; 254/371; 254/901

[58] Field of Search ..... 254/150 R, 138, 186 HC, 254/187.4; 74/810, 812; 192/70.29, 70.3

[56] References Cited

U.S. PATENT DOCUMENTS

| | | | |
|---|---|---|---|
| 3,876,184 | 4/1975 | Eudy | 254/150 R |
| 4,120,486 | 10/1978 | Mehnert | 254/150 R |

*Primary Examiner*—Lenoard D. Christian

*Attorney, Agent, or Firm*—W. G. Fasse; F. D. Gould

[57] ABSTRACT

The present winch may be a so-called single speed or double speed winch. The rope, which loops around a clamping roller with a looping angle smaller than 360°, is operated by at least one power system controlled by a control system through a spring clutch. The control system can close the spring clutch for full power transmission or open the spring clutch completely to interrupt the power train from the power system to the clamping roller. In addition the clutch may be opened partially to control the power transmission for precisely rotating the clamping roller in both rotational directions and stopping the clamping roller in any desired angular position.

15 Claims, 6 Drawing Figures

WINCH FOR THE SLIP-FREE HAULING OF A ROPE

BACKGROUND OF THE INVENTION

The present invention relates to a winch for the slip-free hauling of a rope, for example, on a sailing boat. The rope loops around a clamping roller with a looping angle of less than 360° whereby the rope may be guided through and by the clamping roller in both rotational directions to handle the rope with millimeter precision. The "rope" may be a cable.

My previously granted U.S. Pat. No. 4,120,486 of Oct. 17, 1978 discloses a method and a winch for the slip-free hauling of a rope or similar flexible force transmitting elements. The winch of my patent comprises a housing, a clamping pulley, a relative and/or an absolute arresting system in an operating or control device as well as a gearing system and a brake clutch. The gearing system is used to step down the force of the rope. The control device is used to modify the slippage of the rope. An auxiliary device initiates and controls the braking, releasing, and arresting of the rope. The winch of my patent has found substantial acceptance in the market place. However, there is room for improvement.

OBJECTS OF THE INVENTION

In view of the above it is the aim of the invention to achieve the following objects singly or in combination:

to provide a winch which incorporates all the advantages of the prior art winch and which in addition permits a still more precise control of the rope especially when the latter is paid out under load;

to control the rope with millimeter precision for stopping the rope movement in any desired position and for controlling the rope speed as well as the rope acceleration and deceleration;

to minimize the forces necessary for lowering a load or paying out rope;

to minimize the number of parts necessary for accomplishing the foregoing objectives;

to minimize the forces necessary for decoupling the winch;

to minimize the wear and tear of the winch especially of the spring coupling element of the winch; and to provide a winch which may be "ratcheted" in a stepless manner in both directions.

SUMMARY OF THE INVENTION

According to the invention there is provided a winch comprising a clamping roller around which the rope loops at an angle of less than 360° and a force transmitting system as well as a control system with a controllable coupling spring between the force transmitting system and the control system, whereby the power transmission train from a power input such as a crank to the clamping roller is controlled by said controllable coupling spring. The spring is operable for control by means of a control member, for example, a rotatably supporting housing member so that the force transmission path may be either closed, partially closed, or interrupted.

In order to construct the winch as a so-called two speed winch, the invention divides the main force transmission path in two paths which are partially identical to each other. In this two speed embodiment a sleeve free wheel provides a short circuit for the second force transmission path on the load side thereof. An intermediate member cooperates with the sleeve free wheel in order to fully open the force transmission path in one direction and to open said first force transmission path in the opposite direction in a stepwise or segmental manner.

The just summarized main features of the invention have a number of advantages as compared to the prior art. For example, the control may be accomplished by the winch housing itself, whereby the coupling spring makes sure or guarantees that the rope pay out forces are minimal and the number of structural parts is substantially reduced. In addition, there is the possibility of "ratcheting" in all winch positions while also providing a loose coupling which is universal in every respect. Such coupling transmits a torque movement which satisfies the following formula:

$$M=(2E\cdot I\cdot\delta/D_m^2)\cdot(e^{2\pi\cdot\mu\cdot N}-1).$$

If the spring coupling or clutch is connected at one end thereof with the upper coupling half, the force P satisfies the following formula:

$$P=\Delta P\cdot(e^{2\pi\cdot\mu\cdot N}-1).$$

In the above formulas the letters have the following meaning.

E = Modulus of Elasticity;

I = Inertia Moment;

$\delta$ = Biasing of the Spring;

$D_m$ = Mean Diameter;

$\mu$ = Friction Coefficient;

N = Number of Turns; and $\Delta P$ = Pulling Force of the Radial Auxiliary Spring.

Due to the above described structure such prior art components as connecting elements, brake elements, and coupling elements have been obviated. The spring operates as a mechanical amplifier which satisfies the above formula in the direction of force transmission. The amplifier is substantially completely decoupled substantially without any force transmission in the opposite direction whereby the force necessary for releasing the coupling or clutch is reduced with the number of turns.

The coupling spring itself is substantially not subject to any wear and tear because the pressure forces are small and because the spring operations take advantage of the rope looping about the clamping or pinching roller as is shown by the second factor or term in the above formulas. Incidentally, "e" is the base of the natural logarithms.

The two speed embodiment has the further substantial advantage that it may be ratcheted in both direction substantially in a stepless manner. "Speed" in this context may also means gear or power transmission path.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
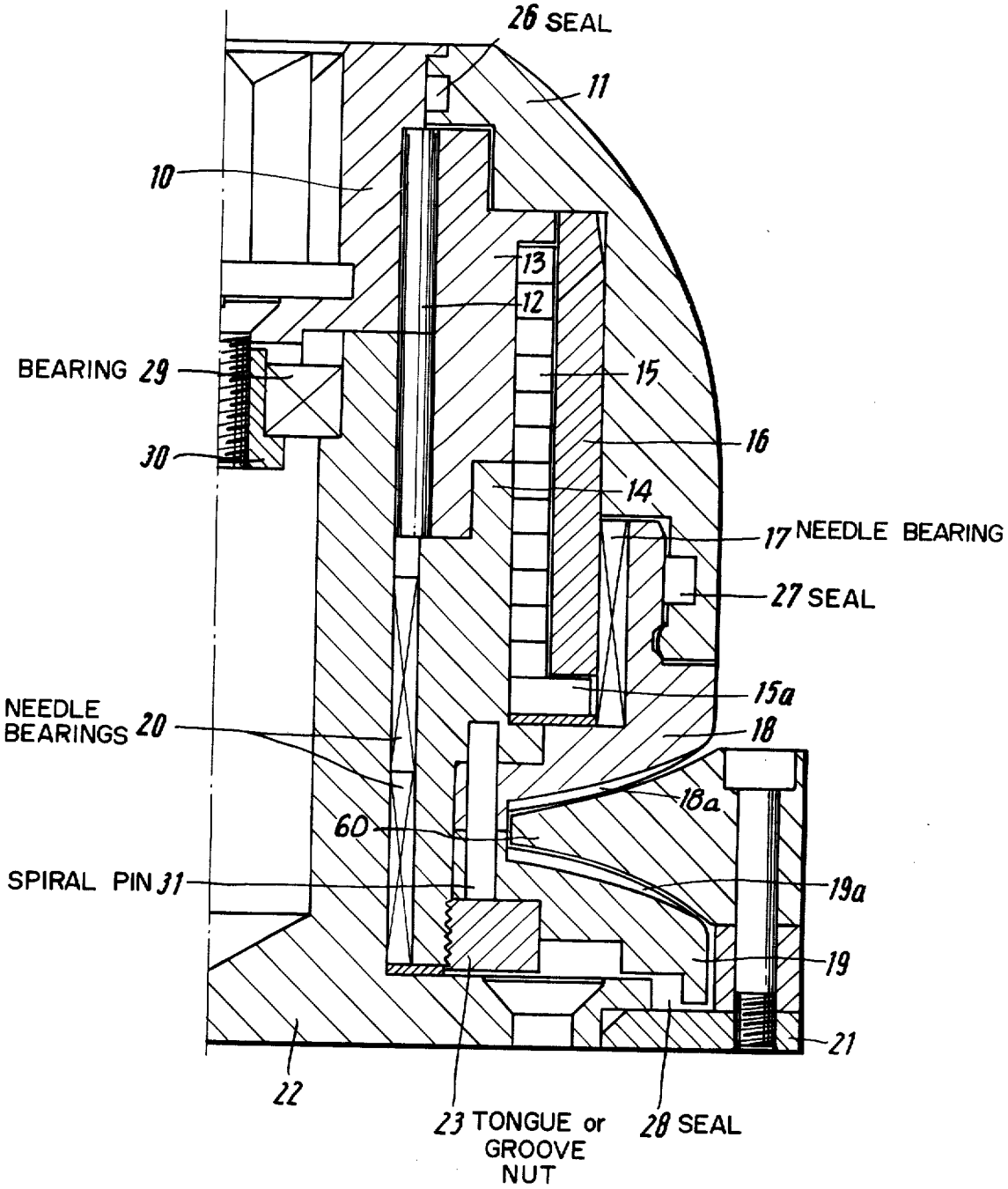
FIG. 1 is a partial section through a winch according to the invention constructed as a so-called single speed winch.

FIG. 1 shows an example embodiment of the invention illustrating a so-called single speed or single gear winch. A crank (not shown) operates the winch when the crank is inserted into the crank socket or insert 10. The crank socket may, for example, have an octagonal cross sectional area. Once the crank is inserted into the socket 10 it may be locked therein. When the crank is turned in one direction, the upper sleeve free wheel 12 remains stationary. The upper sleeve free wheel 12 functions as a ratchet free of backlash or free of lost motion. Stated differently, the crank "ratchets" in this one direction without any force transmission. If the crank is rotated in the opposite, other direction, the crank socket 10 entrains the sleeve free wheels 12 which are pressed into the upper coupling members 13 in a force transmitting manner whereby the upper coupling member 13 is also entrained. The coupling spring 15 engages the upper coupling member 13 due to the inherent spring bias, whereby the lower coupling member 14 is entrained by the spring 15 due to the tightening of the spring, whereby the clamping roller 18, 19 is also entrained. The clamping roller comprises an upper roller member 18 and a lower roller member 19. Due to the just described engagement and entraining of the elements, a force transmitting path is closed or established between the crank socket 10 and the clamping roller or sheave 18, 19.

Simultaneously with the just described establishment of the force transmission path as a result of the rotation of the crank in the opposite direction, the control system is also moved. The control system comprises the rope pay out housing 11, the pay out sleeve 16, and the bent end 15*a* of the spring 15. The relative motion between the spring 15 and the pay out housing 11 including the pay out sleeve 16 is thus zero. In other words, the spring 15 rigidly engages the coupling or clutch members 13 and 14.

The clamping roller members 18, 19 are equipped with profiled clamping or pinching ribs 18*a*, 19*a* to take up the load attached to the rope. Since the clamping roller elements 18, 19 are interconnected, the rope is pinched between these ribs 18*a*, 19*a*. The load is thus transmitted to the winch base 22 through the lower coupling member 14, the coupling or clutch spring 15, the upper coupling member 13 and the lower sleeve free wheel 12, whereby any unintended run back of the rollers 18, 19 and thus of the rope is prevented.

When the rope is to be paid out, the pay out housing 11 and the pay out sleeve 16 are moved in the direction opposite to the load direction whereby the motion relative to the spring 15 is produced. Thus, the spring 15 opens thereby disengaging itself completely or partially from the lower coupling member 14, whereby the clamping rollers 18, 19 may rotate backward in the load direction either without any hindrance or subject to a braking action. Depending on the angle between the spring 15 and the pay out sleeve 16, the spring 15 will be relieved either completely or partially from the lower coupling member 14 whereby it is possible to establish any desired conditions ranging all the way from a totally unimpeded rope pay out to a complete arresting of the rope. The just described control is effective on the length of rope paid out even in millimeter steps, on the speed of rope pay out as well as on the acceleration of the rope pay out. This precise control is accomplished according to the invention by a defined braking action.

When the pay out housing 11 is released, the spring 15 immediately engages the lower coupling member 14 to thereby establish the force transmission path to the base 22 of the winch. Thus, the clamping or pinching roller 18, 19 is immediately arrested or stopped. The rope lifters 60 may be brought into any desired radial engagement position relative to the clamping roller 18, 19 by means of the adjustment ring 21. The winch base 22 takes up the bearing forces applied through the needle bearings 20 as well as the load torque applied through the lower sleeve free wheel 12.

Figure 2:
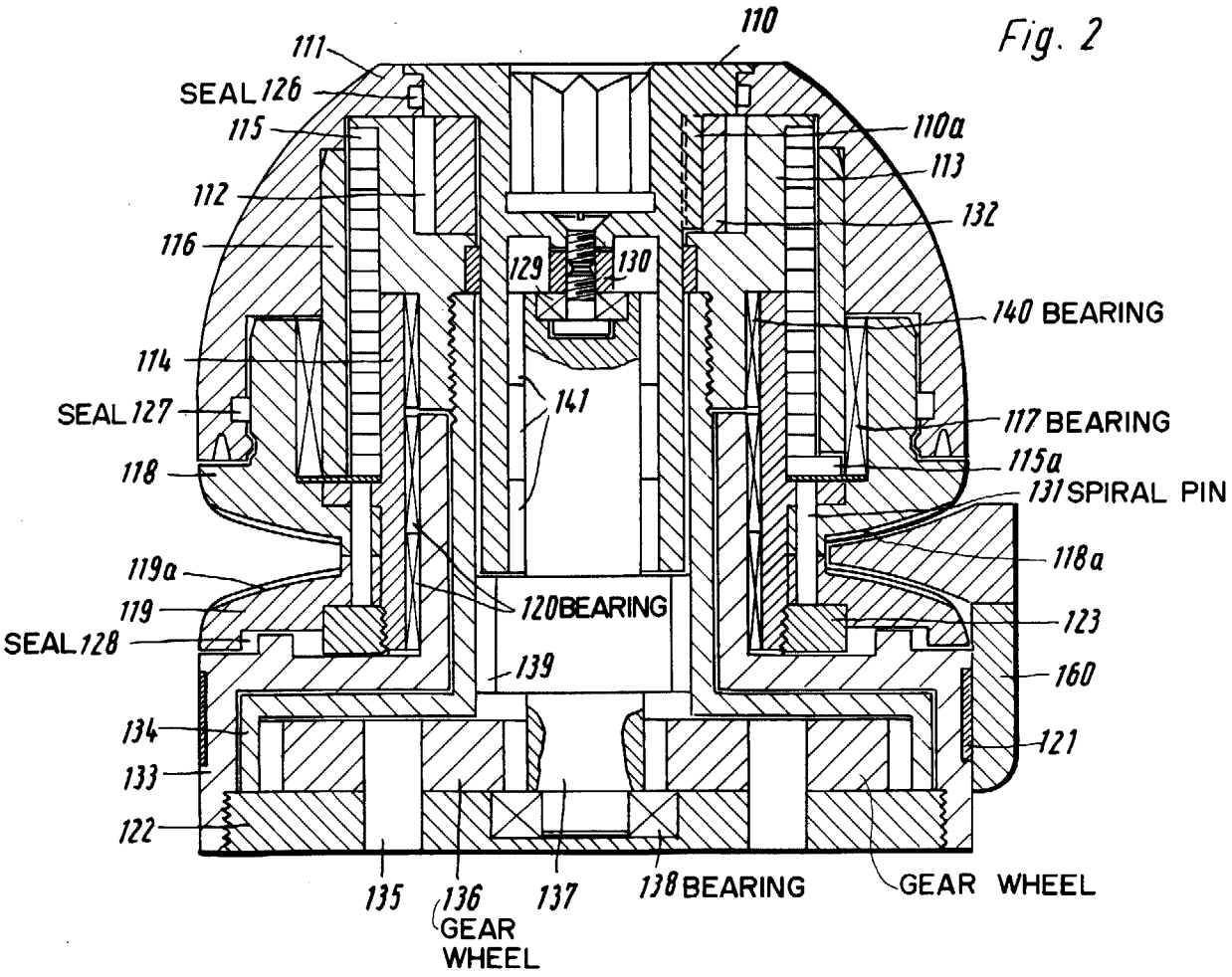
FIG. 2 is a sectional view similar to that of FIG. 1 however, illustrating the embodiment referred to a a so-called double speed winch.

FIG. 2 illustrates an example embodiment of a so-called two speed or two gear winch which is used to take advantage of the moment or torque translation accomplished by the gear. Basically, the structural components of the embodiment of FIG. 2 correspond to the above described components of the single gear or speed winch. Here again the crank may be locked in the crank socket 110. When the crank is rotated in one rotational direction, one force transmitting path or partial path is established through the entraining cam 110*a*, through the intermediate member 32 to the sleeve free wheel 112 and the upper coupling member 113. Simultaneously, the crank socket 110 is able to freely ratchet by means of the sleeve free wheels 141 thereby passing over the central shaft 137 provided with outwardly facing gears. The central shaft 137 in turn freely bypasses the sleeve free wheels 141 due to the entrained upper coupling member 113 and through the connector tulip or bell 134 as well as the loose gear wheel 136. The connector tulip 134 is provided with inwardly facing gear teeth meshing with the gear wheel 136.

The sleeve free wheel 139 is idling at this time. The upper coupling member 113 entrains the biassed spring 115 which in turn entrains the lower coupling member 114 and thus the sheave or clamping roller 118, 119. In this condition the relative motion between the spring 115 and the pay out sleeve 116 as well as the pay out housing 111 is zero.

The loaded rope transmits its force to the clamping roller 118, 119 through the profiled pinching or clamping ribs 118*a*, 119*a*. The clamping rope in turn transmits the force along the following path: lower coupling member 114, coupling spring 115, upper coupling member 113, the connecting tulip 134 with its inwardly facing teeth and the sleeve free wheel 139 which provides a self locking, and through the central shaft 137 with its outwardly facing gear teeth as well as the gear wheel 136 loosely supported by the bolt 135 and back to the connecting tulip 134. The intermediate body 133 is rigidly secured to the base plate 122 and takes up the bearing forces through the bearing 120 of the lower clutch or coupling member 114. The sleeve free wheel 139 takes up the load torque through the central shaft 137 with its outer teeth and through the loose gear wheel 136 as well as through the connecting tulip 134 with its inwardly facing teeth. It is remarkable in this context that with a translation ratio of 1:n the sleeve free wheel 139 is required to take up only a portion of the output torque which portions correspond to the output torque divided by n+1, n being the number of turns.

When the pay out housing 111 and thus the pay out sleeve 116 are moved in a direction contrary to the load direction as described above, a motion relative to the spring 115 is produced whereby the latter releases itself from the lower coupling member 114 completely or partially thereby in turn releasing the supported clamping roller members 118, 119 for movement in the load direction either without any hindrance or subject to a braking action. However, the spring 115, which is relieved by the action of the pay out sleeve 116, immediately stops the clamping roller 118, 119 again. If the crank engaging the crank socket 110 is now turned in the opposite direction, the force transmitting path extends directly through the following elements: the sleeve free wheels 141, the central shaft 137 with its outer teeth, the loose gear wheel 136, the connecting tulip 134 with its inwardly facing teeth, and the upper coupling member 113 connecting to the spring 115. The cam 110*a* assumes the ratcheting position due to the counter rotation of the upper coupling member 113, the sleeve free wheel 112 and of the intermediate member 132, whereby the sleeve free wheel 112 as well as the intermediate member 132 are in the free wheeling position.

When the crank socket 110 moves in the preceding direction within the segment 132*a* or in the intermediate member 132, no force is effective on the crank which is thus in the ratcheting position. If now the movement or rather the rotation is in the opposite direction again, the gear transmission is immediately effective without any play or backlash independently of the position of the cam 110*a* in the segment 132*a*. The just described feature is also effective if a switch over takes place from the direct force transmission to transmission through the gear train due to change in the direction.

The paying out of rope takes place in the manner described above. The load applied to the rope is taken up independently of which power train or path is employed such taking-up being accomplished by the sleeve free wheel 139 through the self-locking action of the gear.

If the free wheel 139 should ever fail, its function is taken over automatically by the sleeve free wheel 112 however with backlash in the segment 132*a*. Thus, a desirable redundancy in safety is accomplished without any additional components which is yet another advantage of the invention.

Figure 3:
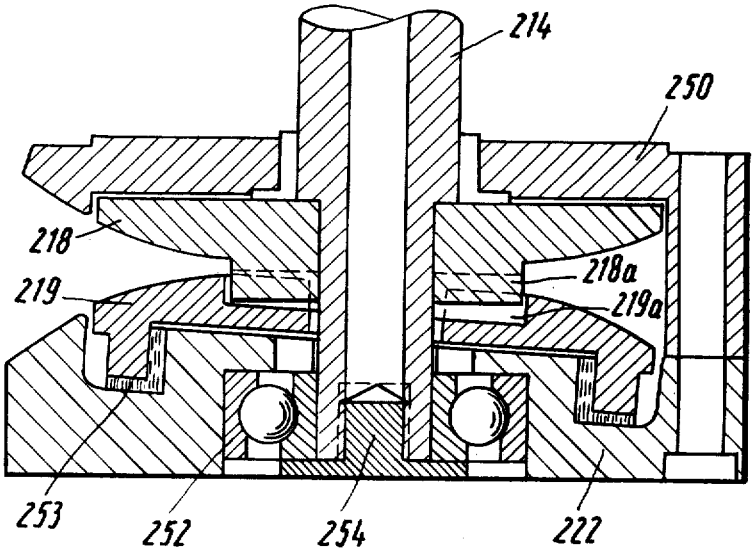
FIG. 3 is a sectional view through a clamping sheave or pinching roller of which at least one side is maintained in a slanted position.

FIG. 3 illustrates an arrangement of the clamping roller or sheave sections 218, 219. At least one of the sections, for example 218, is able to take up a slanted position relative to the vertical longitudinal axis of the winch. The prominent feature of this structure is the clamping of the two roller paths or sections 218, 219 within the lower coupling member 214 and with the aid of two pressure bearings 252, 253 which are effective on the same side of the clamping roller. Due to this structure it is possible that even the largest forces tending to spread the two roller sections away from each other can be taken up centrally and without any special effort. The spreading forces are caused by the rope and effective on the clamping roller sections which are loose relative to each other. This type of structure is especially advantageous where the largest rope forces are effective. As long as it is possible to remove the rope or cable from the clamping roller with the aid of the rope lifter, there is no need to locate one half of the clamping roller in a slanted position.

Figure 4:
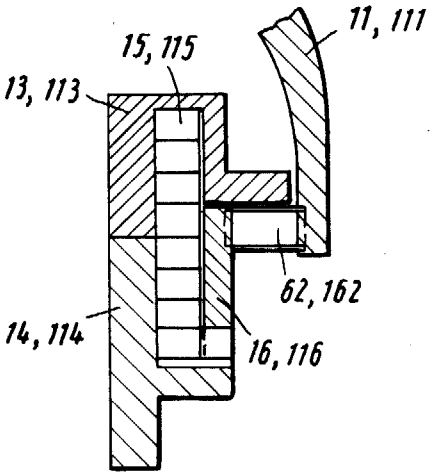
FIG. 4 is a partial sectional view illustrating the position of gear wheel means for the reversal of the rope pay out direction.

FIG. 4 shows a sectional view through a modification which is applicable to the embodiment of FIG. 1 as well as to the embodiment of FIG. 2 for the purpose of changing the rope pay out direction and for interrupting the force transmission paths for the rope or cable pay out. For this purpose there is arranged a reversing means such as a gear wheel or wheels 62, 162 operatively secured to the upper coupling member 13, 113 and meshing with the pay out housing 11, 111 as well as with the pay out sleeve 16, 116. A lever could also be used as a reversing means. As shown in FIGS. 1 and 2 the coupling spring 15, 115 is operatively interposed between the upper coupling member 13, 113 and the lower coupling member 14, 114.

Figure 5:
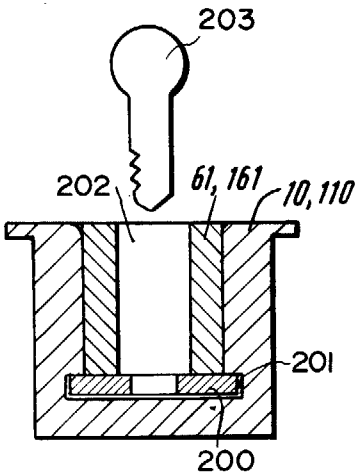
FIG. 5 illustrates a sectional view of the crank insert including locking means for securing the winch against theft.

FIG. 5 illustrates a vertical section through the crank socket 10, 110 provided with a security insert 61, 161 having a cam or flange portion 200 cooperating with a recessed shoulder 201 and provided with a keyhole 202 for insertion of a key 203 whereby the winch may be locked against theft. This insert covers the assembly screw shown centrally in FIGS. 1 and 2 whereby removal of the winch is prevented.

Figure 6:
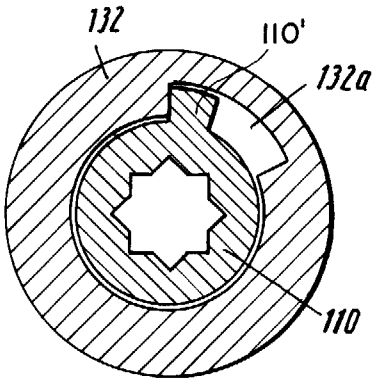
FIG. 6 is a sectional view horizontally through the crank insert including an intermediate member for the ratchet including a cam end segment.

As shown in FIG. 6 illustrating a sectional view through the top portion of the winch where the crank socket 110 is located, the intermediate member 132 is provided with a segmental cut-out 132*a* which is engaged by the cam member 110' of the socket 110.

As mentioned, the invention achieves a number of advantages which constitute a substantial advance in the art. By using sleeve free wheels, pawls have been avoided. In addition, such sleeve free wheels have the advantage that a simple ratcheting function is accomplished without any play or backlash and substantially completely noiseless. The rotatable pay out housing 11, 111 makes it possible to easily handle the winch. Also the assembly and disassembly of the winch is greatly facilitated. It is merely necessary to remove the crank socket 10, 110 which is secured to the bearing 29, 129 by means of a special nut 30, 130. Thereafter the winch proper may be disassembled. The above mentioned locking feature with the insert 61, 161 is another advantage of the invention.

Further, it is significant that according to the invention the pay out forces are minimized whereby the present winch can even be handled by a child. Further, the controllability, especially as far as rope pay out is concerned, has been optimized and the entire structure is compact with a small overall height combined with a maximal load transmission capability. Besides, one basic clamping roller type is suitable for different diameter ropes or cables because the present clamping roller is suitable for thin and thick ropes alike.

The above advantages are also present in the two speed or two path winch with the additional advantage that the embodiment of FIG. 2 is capable of ratcheting continuously in both directions. In order to achieve a small overall structural height and to avoid one sided moments or torque, three loose gear wheels are used in the gear train. Further, due to the structure of the sleeve free wheels, or rather due to the location of the sleeve free wheels on the side having the lower torque moments, it is possible to use components of small structural dimension. The arrangement of the take over gear train with its two self locking features provides an increased safety whereby the gear may be constructed in a building block system for several transmission or translation ratios thereby requiring merely an adaptation of the gear wheels of the connecting tulip and the central shaft. Thus, even for the two path winch only a single structural type is required. Incidentally, the spring 15, 115 could be a coil spring with helical windings.

Although the invention has been described with reference to specific example embodiments, it will be appreciated that it is intended to cover all modifications and equivalents within the scope of the appended claims.

What is claimed is:

1. A winch, comprising base means, crank power input means and clamping sheave means operatively supported on said base means, power transmission means including controllable coupling spring means operatively interposed between said power input means and said sheave means for forming a power transmission path, and control means operatively connectable to said coupling spring means for closing, opening or partially opening said power transmission path whereby the movement, speed, acceleration, deceleration and stopping of said sheave means is precisely controllable, said power transmission means comprising upper and lower coupling members (13, 14), said upper coupling member (13) having a shoulder forming a stop limiting upward movement of said coupling spring means (15), said winch further comprising sleeve free wheeling means (12) inserted into said upper coupling member with a press fit.

2. The winch of claim 1, further comprising elongated flexible means looping around said clamping sheave means at a looping angle of less than 360°.

3. The winch of claim 1, wherein said control means comprise rotatable winch housing means (11, 111) operatively connected to said coupling spring means.

4. A winch, comprising base means, crank power input means and clamping sheave means, power transmission means operatively interposed between said crank power input means and said sheave means, said power transmission means comprising two partially identical power transmission systems, including components forming part of both systems, control means including coupling spring means operatively connected for controlling one of said systems by said control means through said coupling spring means, first sleeve free wheeling means (139) operatively arranged to short circuit the other power transmission system on the load side thereof, second free wheeling means (112) including an intermediate member (132) operatively arranged in said one system for fully interrupting said one system when said one system is rotated in one direction and for partially interrupting said one system when said one system is rotated in the opposite direction, said winch further comprising upper and lower clutch means (113, 114), connector tulip means (134) having inner gear teeth, and needle bearing means (140) operatively interposed between said upper clutch means (113) and said lower clutch means (114), said upper clutch means being firmly coupled to said connector tulip means (134).

5. The winch of claim 4, further comprising crank socket means (10, 110) constructed as locking means and as ratcheting means.

6. The winch of claim 4, comprising upper and lower coupling members (13, 14; 113, 114), pay out sleeve means (16, 116), and bearing means (17, 117) operatively supporting said pay out sleeve means relative to said lower coupling member.

7. The winch of claim 4, comprising upper and lower coupling members (13, 14; 113, 114), pay out sleeve means (16, 116), means securing said sheave means (18, 118) to said lower coupling member (14, 114) substantially in a force transmitting manner, and bearing means (17, 117) operatively supporting said pay out sleeve means (16, 116) on said securing means.

8. The winch of claim 4, further comprising sealing means (26, 27, 28; 126, 127, 128) in the form of O-rings, so called "Quad"-rings, or vector-seals operatively interposed in said winch to seal the winch in a watertight manner, especially in a sea water-tight manner.

9. The winch of claim 4, further comprising rope or cable lift-out means (60, 160) and movable adjustment means (21, 121) operatively supporting said lift-out means.

10. The winch of claim 4, further comprising crank socket means (10, 110) and lockable insert means (61, 161) for said crank socket means.

11. The winch of claim 4, comprising base means (122), said power transmission means comprising crank socket means (110), central shaft means (137) having external gear teeth, bearing means (138) supporting said central shaft means (137) relative to said base means (122), connecting tulip means (134) having internal gear teeth, and sleeve free wheel means (139, 141) operatively interposed between said central shaft and said crank socket means and between said central shaft and said connecting tulip means (134).

12. The winch of claim 4, further comprising winch base means (222), shaft means (214), bearing means (252) secured to said shaft means (214) and to said winch base means (222), said winch base means having a slanted surface, said clamping roller means comprising two sections (218, 219), one section being secured to said shaft means whereas the other section is adapted to rotatably slide relative to said slanted surface, preferably through a pressure bearing (253) interposed between said other section and said base means (222), said roller sections comprising gear teeth (**218*a*, 219*a*) meshing with each other whereby both roller sections may rotate with said shaft means (214**).

13. The winch of claim 4, wherein said clamping roller means (18, 19; 118, 119) comprise two half sections held together and secured to the lower coupling member (14, 114) by spiral pin means (31, 131) and a tongue or groove nut (23, 123).

14. The winch of claim 4, wherein said coupling or clutch spring (15, 115) is substantially loose, except for its selfbiasing, and connects the two coupling halves (13, 14; 113, 114) in a force transmitting manner to each other, whereby the loading of the coupling spring (15, 115) decreases from its center portion toward both sides (ends), or the coupling spring is secured to the upper coupling or clutch half (13, 113) in a formlocking manner, whereby the spring (15, 115) connects the upper coupling or clutch half (13, 113) to the lower coupling or clutch half (14, 114) in a force transmitting manner due to its inherent spring bias or due to biasing by means of a radial spring, in which case an inherent bias is effective only on the first windings of the coupling spring (15, 115), so that the loading forces on the spring (15,

115) decrease from the upper coupling half (13, 113) to the lower coupling half (14, 114).

15. The winch of claim 4, wherein between the pay out housing (11, 111) and the pay out sleeve (16, 116) reversing means (62, 162) are operatively interposed, such as a gear wheel (62, 162) supported by the upper coupling or clutch half (13, 113) or a lever for changing the pay out direction and for interrupting the pay out path.

* * * * *